United States Patent [19]

Shimizu

[11] Patent Number: 5,046,401

[45] Date of Patent: Sep. 10, 1991

[54] WOBBLE PLATE COMPRESSOR WITH A ROTATION PREVENTION MECHANISM

[75] Inventor: Shigemi Shimizu, Sawa, Japan

[73] Assignee: Sanden Corporation, Gunma, Japan

[21] Appl. No.: 564,837

[22] Filed: Aug. 9, 1990

[30] Foreign Application Priority Data

Aug. 10, 1989 [JP] Japan ..... 1-205810

[51] Int. Cl.[5] ..... F01B 3/00; F01B 13/04

[52] U.S. Cl. ..... 92/12.2; 92/71; 417/222 S; 74/60

[58] Field of Search ..... 92/12.2, 71; 417/222, 417/269, 222 S; 74/60

[56] References Cited

U.S. PATENT DOCUMENTS

| | | | |
|---|---|---|---|
| 2,405,006 | 7/1946 | Ashton | 74/60 |
| 3,834,281 | 9/1974 | Heyl et al. | 417/222 |
| 4,037,993 | 7/1977 | Roberts | 417/222 S |
| 4,061,443 | 12/1977 | Black et al. | 417/269 |
| 4,108,577 | 8/1978 | Brucken et al. | 417/222 |
| 4,231,713 | 11/1980 | Widdowson et al. | 417/222 |
| 4,428,718 | 1/1984 | Skinner . | |
| 4,480,964 | 11/1984 | Skinner . | |
| 4,543,043 | 9/1985 | Roberts . | |
| 4,586,874 | 5/1986 | Hiraga et al. . | |
| 4,776,259 | 10/1986 | Takai . | |
| 4,782,712 | 11/1988 | Takahashi et al. | 92/12.2 |
| 4,875,834 | 10/1989 | Higuchi et al. | 417/269 |
| 4,913,627 | 4/1990 | Terauchi | 417/222 S |
| 4,954,050 | 9/1990 | Higuchi et al. . | |

FOREIGN PATENT DOCUMENTS

| | | | |
|---|---|---|---|
| 0460190 | 10/1949 | Canada | 74/60 |
| 0366348 | 5/1990 | European Pat. Off. | 417/269 |
| 56-77578 | 6/1981 | Japan . | |
| 0205471 | 8/1988 | Japan | 417/269 |
| 0290974 | 11/1989 | Japan | 417/269 |
| 0023274 | 1/1990 | Japan | 417/269 |
| 2153922A | 8/1985 | United Kingdom . | |

*Primary Examiner*—Edward K. Look
*Assistant Examiner*—Thomas Denion
*Attorney, Agent, or Firm*—Banner, Birch, McKie & Beckett

[57] ABSTRACT

A wobble plate compressor including a housing having a cylinder block provided with a plurality of cylinders and a crank chamber is disclosed. A plurality of pistons are coupled to a wobble plate and slidably fitted in the cylinders. A drive shaft is rotatably supported in the housing. An inclined plate connected to the wobble plate is rotated by the drive shaft through a rotor. The rotational motion of the inclined plate is converted into nutational motion of the wobble plate. A rotation preventing mechanism in used to prevent rotational motion of the wobble plate. The rotation preventing mechanism has a guide plate extending within the crank chamber, a cylindrical block including a vertical groove formed therein and retaining system for retaining the cylindrical block on the wobble plate such that the vertical groove is slidably fitted on the guide plate. The retaining system includes a female screw formed on one of the periphery of the wobble plate and the upper surface of the cylindrical block and a male screw provided on the other of the periphery of the wobble plate and the upper surface of the cylindrical block. When the male screw is screwed in the female screw, the cylindrical block is securely connected to the wobble plate by the retaining system. The rotation preventing mechanism can thereby be easily assembled and disassembled.

10 Claims, 4 Drawing Sheets

WOBBLE PLATE COMPRESSOR WITH A ROTATION PREVENTION MECHANISM

BACKGROUND OF THE INVENTION

1. Field of the Invention

The present invention relates to a wobble plate compressor, and more particularly, to the improvement of a rotation preventing mechanism to prevent rotation of the wobble plate in this type of compressor.

2. Description of the Prior Art

In wobble plate type compressors, pistons are reciprocated in cylinders by conversion of rotational motion of an inclined plate into nutational motion of a wobble plate. This type of compressor is well known in the art. Inclined wobble plate compressors are the variable-displacement compressors, wherein the angle of an inclined plate relative to a drive shaft is variable and the displacement of the pistons can be controlled by controlling the angle of the inclined plate. These compressors are also well known in the art, and one example is disclosed in unexamined Japanese Patent Publication SHO 56-77578.

In such variable-displacement wobble plate compressors, rotational motion of the wobble plate must be prevented. FIGS. 7 to 9 show a conventional rotation preventing mechanism for a wobble plate. A hole 3 is formed in the lower portion of the wobble plate and extends in the axial direction of wobble plate 1 from its periphery.

Cylindrical block 5 is disposed in hole 3. A pair of arc-shaped caulking pieces 7 are provided around the opening portion of hole 3. Cylindrical block 5 is retained in hole 3 by bending caulking pieces 7 in the direction of the bottom surface of the cylindrical block. Vertical groove 9 is defined in cylindrical block 5 and extends from the bottom surface of the block in the axial direction of wobble plate 1. One side of guide plate 11 is slidably fitted into groove 9. Cylindrical block 5 can rotate in hole 3 in its circumferential direction relative to wobble plate 1. Thus, wobble plate 1 can move nutationally.

In this type of rotation preventing mechanism, hole 3 of wobble plate 1 and caulking pieces 7 constitute a system for retaining cylindrical block 5, and preventing it from being dislodged from hole 3. This prevents the rotation of wobble plate 1.

Another conventional rotation preventing mechanism is shown in FIGS. 10 to 12. Pin 13 is attached to cylindrical block 5 near the head of the cylindrical block. The ends of the pin project from the surface of the cylindrical block in the radial direction. A hole 3 is formed in wobble plate 1, with openings 3*a* and 3*b* extending in the depth direction of hole 3 at both sides of the wobble plate. Further grooves 3*c* extend in the circumferential direction on the inner surface of hole 3 for containing therein the ends of pin 13. When cylindrical block 5 is assembled, pin 13 is matched with openings 3*a* and 3*b*. The cylindrical block is then inserted into hole 3. Finally, the ends of pin 13 are engaged with groove 3*c* by rotating the block. Thus, cylindrical block 5 is retained in hole 3 and may not be dislodged from the hole.

In this type of rotation preventing mechanism, pin 13 and groove 3*c* constitute a system for retaining cylindrical block 5 in hole 3. Also, rotation of wobble plate 1 is prevented by engaging guide plate 11 with vertical groove 9. The cylindrical block 5 allows nutational motion of wobble plate 1 since pin 13 slides along groove 3*c* accompanying the nutational motion of the wobble plate (unexamined Japanese Patent Publication SHO 63-205471).

However, there are problems associated with the prior art retaining systems. In the retaining system of the rotation preventing mechanism shown in FIG. 7, cylindrical block 5 is retained in hole 3 by bending caulking pieces 7. Thus, the caulking pieces are deformed if the block is detached from the hole for any reason. If this happens, the wobble plate cannot be reused, and cylindrical block 5 cannot be disassembled. If the cylindrical block 5 is replaced, the wobble plate 1 must be replaced at the same time.

In the retaining system of the rotation preventing mechanism shown in FIG. 10, it is difficult to form groove 3*c*. Moreover, since pin 13 is brought into contact with wobble plate 1, it is difficult to provide a durable contact area. A large stress is applied to the contact area when cylindrical block 5 slides along guide plate 11. Therefore, pin 13 and/or groove 3*c* are likely to abrade in a relatively short time.

SUMMARY OF THE INVENTION

Accordingly, an object of the present invention is to provide a wobble plate compressor which prevents the rotation of the wobble plate thereof and has a rotation preventing mechanism that may be easily assembled and disassembled.

This object is accomplished by providing a wobble plate compressor comprising a compressor housing having a cylinder block provided with a plurality of cylinders and a crank chamber adjacent the cylinder block. A piston is slidably fitted within each of the cylinders. A drive shaft is rotatably supported in the housing, and a rotor is fixed on the drive shaft and further connected to an inclined plate. A wobble plate is provided adjacent the inclined plate with each of the plurality of pistons coupled at one end with the wobble plate. Rotational motion of the inclined plate is converted into nutational motion of the wobble plate. Lastly, a rotation preventing mechanism prevents rotation of the wobble plate. The rotation preventing mechanism includes a guide plate extending within and fixed in the crank chamber and a cylindrical block including a vertical groove formed therein. Lastly, a system is provided for retaining the cylindrical block on the wobble plate such that the vertical groove is slidably fitted on the guide plate. The retaining system includes a female screw formed on one of the periphery of the wobble plate and the upper surface of the cylindrical block and a male screw provided on the other of the periphery of the wobble plate and the upper surface of the cylindrical block. The male screw is screwed into the female screw.

In the wobble plate compressor, the vertical groove of the cylindrical block is slidably fitted on the guide plate. The cylindrical block is retained by the wobble plate by the retaining system including the female screw and the male screw. Thus, rotation of the wobble plate is prevented by the guide plate and the cylindrical block. On the other hand, since the cylindrical block can move reciprocally along the guide plate, the wobble plate is allowed nutational motion. Moreover, since the retaining system is formed by a female screw and a male screw, the cylindrical block can be easily adjusted to an optimum position. That position corresponds to the angle of the inclined plate. Further, the male screw may easily rotate within the female screw such that the wobble plate smoothly moves in nutational motion.

In the assembly of the rotation preventing mechanism, the guide plate is inserted into the compressor housing. One end of the guide plate is attached to the cylinder block. The cylindrical block is attached to the periphery of the wobble plate. The wobble plate is then inserted into the compressor housing with the vertical groove fitted on the guide plate. After other parts are assembled, a front end plate is attached to the compressor housing to complete assembly. Since the cylindrical block and the wobble plate can be preassembled and the wobble plate can be placed into the compressor housing with the vertical groove of the cylindrical block slidably fitted on the guide plate by allowing the cylindrical block to move along the guide plate, dislocation of parts can be prevented during assembly. Thus, assembly is easily performed.

In the disassembly of the rotation preventing mechanism, the assembly steps are performed in reverse order. Even if a problem occurs in the rotation preventing mechanism, disassembly can be easily performed. The cylindrical block is removed from the wobble plate by disengaging the connection between the female and male screws. Since the female and male screws of the retaining means are engaged with each other by screwing, abrasion that occurred in conventional compressors when the cylindrical block and the wobble plate were relatively rotated is greatly reduced.

BRIEF DESCRIPTION OF THE DRAWINGS

Some preferred exemplary embodiments of the invention will now be described with reference to the accompanying drawings, which are given by way of example only, and are not intended to limit the present invention.

DETAILED DESCRIPTION OF PREFERRED EMBODIMENTS OF THE INVENTION

Figure 1:
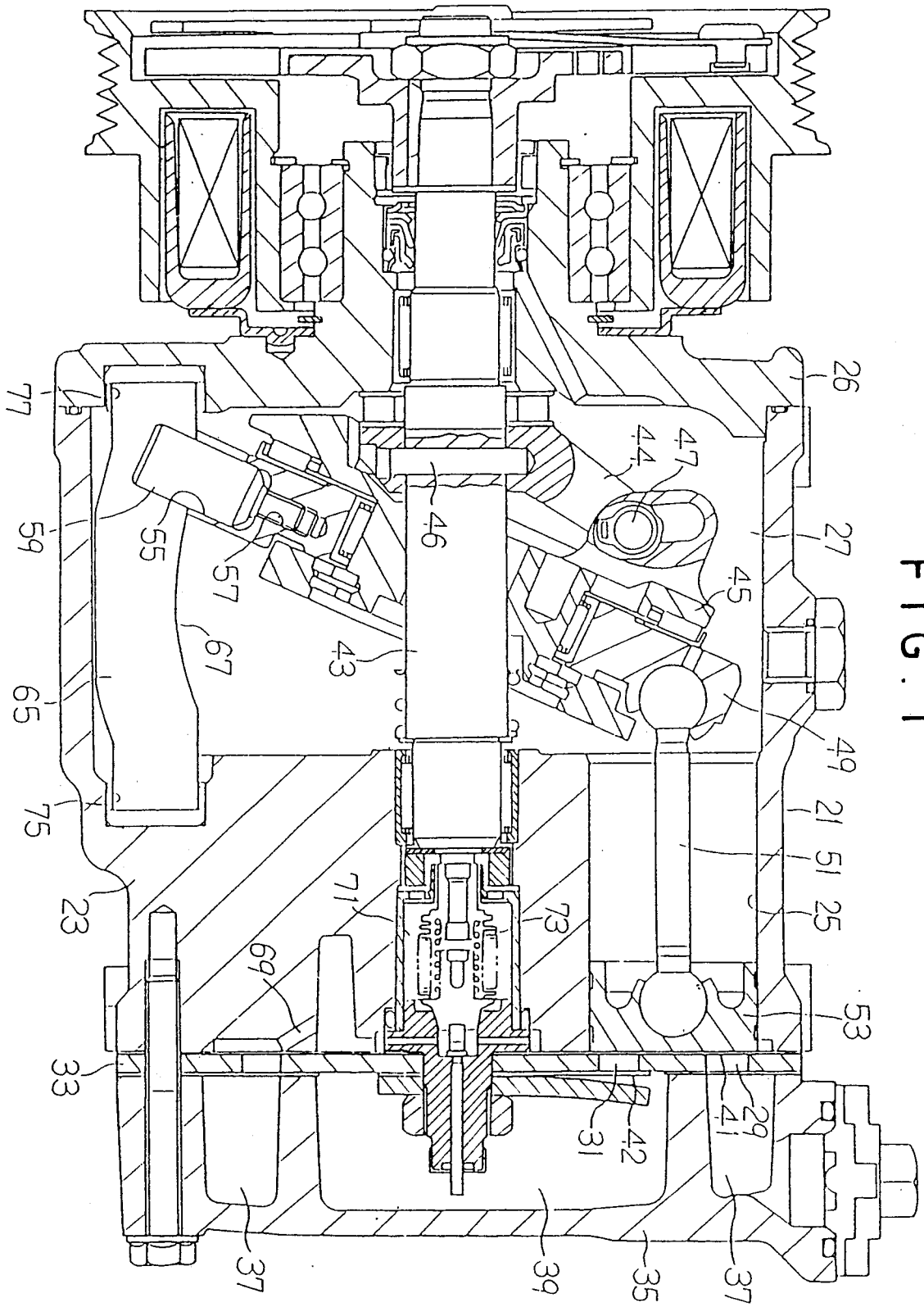
FIG. 1 is a vertical sectional view of a wobble plate compressor according to a first embodiment of the present invention.

Referring to the drawings, FIG. 1 illustrates a wobble plate compressor according to a first embodiment of the present invention. In this embodiment, the compressor is of the variable-displacement type.

The compressor includes compressor housing 21 and cylinder block 23 provided on one end of the housing. A plurality of cylinders 25 are formed in cylinder block 23 (only one cylinder is shown in FIG. 1). The other end portion of housing 21 is closed by front end plate 26. Crank chamber 27 is defined between front end plate 26 and cylinder block 23.

Cylinder head 35 is attached to the end surface of cylinder block 23 by valve plate 33 having suction port 29 and discharge port 31. Cylinder head 35 has suction chamber 37 in selective communication with cylinder 25 through suction port 29. Cylinder head 35 also contains a discharge chamber 39 in selective communication with cylinder 25 through discharge port 31. Suction valve 41 and discharge valve 42 are provided on suction port 29 and discharge port 31, respectively. A fluid suction port (not shown) and a fluid discharge port (not shown) are also provided on cylinder head 35. The respective ports are connected to an external circuit (not shown).

Drive shaft 43 extends from the outside of front end plate 26 into crank chamber 27. It is rotatably supported by front end plate 26 and cylinder block 23. Rotor 44 is fixed to drive shaft 43 via pin 46 and rotates together with drive shaft 43. Inclined plate 45 is connected to rotor 44 by a hinge including pin 47. Therefore, inclined plate 45 also rotates with drive shaft 43. The angle of inclination of the inclined plate is variable by use of the hinged connection.

Wobble plate 49 is rotatably supported on the periphery of inclined plate 45 on the surface facing cylinder block 23. One end of each piston rod 51 is connected to the radial outer portion of wobble plate 49 by a spherical connection. The other end of each piston rod 51 is connected to its respective piston 53, which is disposed slidably in a respective cylinder 25.

Figure 2:
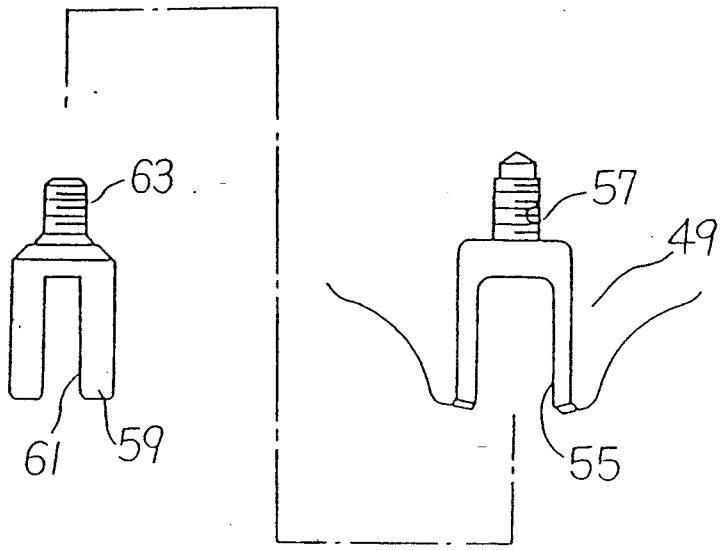
FIG. 2 is an exploded view of the rotation preventing mechanism of the compressor shown in FIG. 1.
Figure 3:
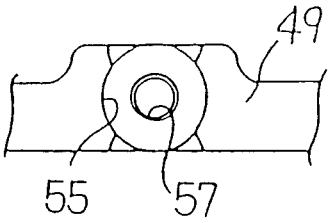
FIG. 3 is a bottom view of the wobble plate shown in FIG. 2.

Referring to FIGS. 2 and 3, a hole 55 extends in the radial direction of wobble plate 49 and is formed in the lower portion of the wobble plate. Female screw 57 is formed on the upper interior surface of the wobble plate and extends in the radial direction of wobble plate 49. Cylindrical block 59 is disposed in hole 55. Cylindrical block 59 has a vertical groove 61 on one side extending in the radial direction of wobble plate 49 which is slidably fitted on a guide plate described later. Cylindrical block 59 has a male screw 63 projecting from its other surface in the radial direction of wobble plate 49. Cylindrical block 59 is retained by wobble plate 49 by screwing male screw 63 into female screw 57. Thus, male screw 63 and female screw 57 constitute a retaining system.

Referring again to FIG. 1, guide plate 65 is disposed in the lower space of crank chamber 27 in parallel to drive shaft 43. Vertical groove 61 of cylindrical block 59 is slidably fitted on the upper edge portion of guide plate 65. The upper edge of guide plate 65 has arc region 67 protruding downwards. Guide plate 65 is supported by front end plate 26 at one end and by cylinder block 23 at its other end.

Cylindrical block 59 is screwed into female screw 57 of wobble plate 49 to be in a predetermined position. Specifically, cylindrical block 59 is positioned such that the cylindrical block can rotate in a manner corresponding to the angle of the inclination of inclined plate 45. At the same time, cylindrical block 59 is positioned such that male screw 63 can rotate relative to female screw 57, such that wobble plate 49 is allowed to move in a direction different from the longitudinal direction of guide plate 65 as inclined plate 45 rotates. As a result, the nutational motion of wobble plate 49 is allowed by the rotation of cylindrical block 59. On the other hand, rotation of wobble plate 49 is prevented by cylindrical block 59 and guide plate 65.

Communication hole 69 for communication between crank chamber 27 and suction chamber 37 is formed in cylinder block 23 and valve plate 33. Pressure sensitive chamber 71 is formed in the path of communication hole 69. Bellows valve 73 is provided in this pressure sensitive chamber 71. Bellows valve 73 allows communication between suction chamber 37 and crank chamber 27 by opening its valve when the pressure on the inside of the crank chamber which is introduced into the inside of pressure sensitive chamber 71 becomes higher than a predetermined value (the inside pressure of the bellows). This reduces the pressure on the inside of the crank chamber.

When pressure inside the crank chamber 27 is high, the bottom dead center of piston 53 shifts toward the top dead center, and the stroke of the piston becomes smaller. Thus, the angle of inclination of inclined plate 45 and wobble plate 49 relative to drive shaft 43 becomes smaller (i. e. becomes near right angle), and compression capacity thereby decreases. On the contrary, when the pressure inside the crank chamber 27 is low, the stroke of the piston becomes greater because the back pressure of piston 53 is small. Therefore, the angle of inclination of inclined plate 45 and wobble plate 49 relative to drive shaft 43 increases, and compression capacity also increases.

In operation, drive shaft 43 is rotated by an external power source (not shown) which rotates rotor 44 and inclined plate 45 together. However, since wobble plate 49 is rotatably provided on inclined plate 45 and cylindrical block 59, which is attached to the wobble plate 49, is fitted on guide plate 65, rotation of the wobble plate 49 is prevented. Therefore, wobble plate 49 is moved nutationally in response to the motion of the inclined surface of inclined plate 45. Each piston rod 51 moves reciprocally, and thus each piston 53 reciprocates in the corresponding cylinder 25. During operation, cylindrical block 59 reciprocates along arc region 67 of guide plate 65.

In the assembly of this variable-displacement compressor, and particularly in the assembly of the rotation preventing mechanism, guide plate 65 is inserted into crank chamber 27 such that the end portion of the guide plate is inserted into hole 75 formed on the lower portion of cylinder block 23. The assembled body of wobble plate 49 retaining cylindrical block 59 and inclined plate 45 is inserted into housing 21 while the cylindrical block is fitted on the upper portion of guide plate 65. Thereafter, other parts are assembled in housing 21, and front end plate 26 is attached to the housing such that the other end portion of guide plate 65 is inserted into hole 77 in the front end plate. In this assembly, since cylindrical block 59 is attached to wobble plate 49, the cylindrical block is prevented from collapsing when the wobble plate is assembled after guide plate 65 is assembled. Therefore, assembly is easy.

For disassembly, the assembly operations are performed in reverse. Cylindrical block 59 can be easily detached from wobble plate 49 by detaching male screw 63 from female screw 57.

Figure 4:
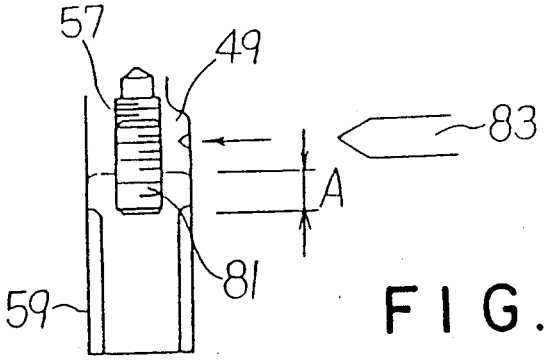
FIG. 4 is a vertical sectional view of a retaining system according to a second embodiment of the present invention.
Figure 5:
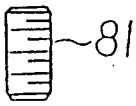
FIG. 5 is a side view of the stud bolt shown in FIG. 4.
Figure 6:
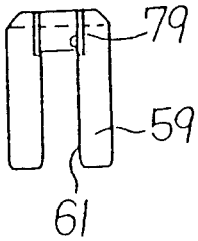
FIG. 6 is a vertical sectional view of the cylindrical block shown in FIG. 4.
Figure 7:
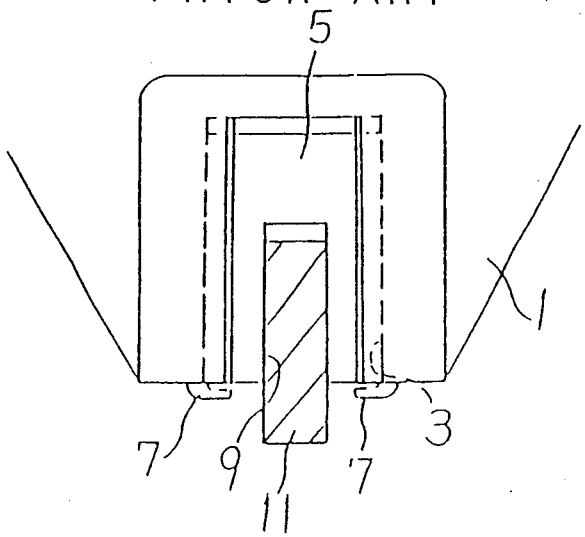
FIG. 7 PRIOR ART
FIG. 7 is a vertical sectional view of a conventional rotation preventing mechanism.
Figure 8:
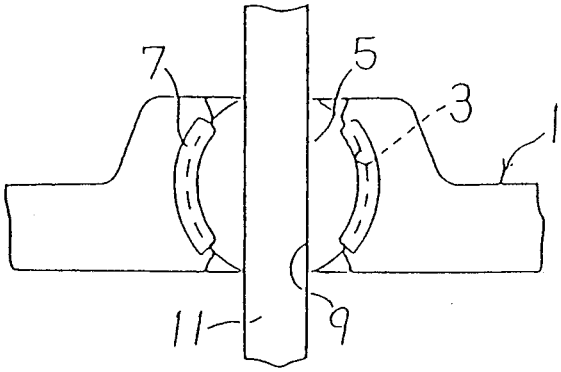
FIG. 8 PRIOR ART
FIG. 8 is a bottom view of the mechanism shown in FIG. 7.
Figure 9:
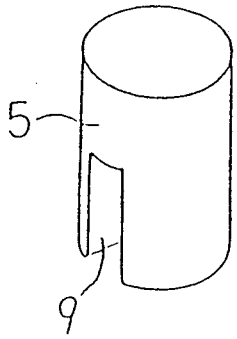
FIG. 9 PRIOR ART
FIG. 9 is a perspective view of the cylindrical block shown in FIG. 7.
Figure 10:
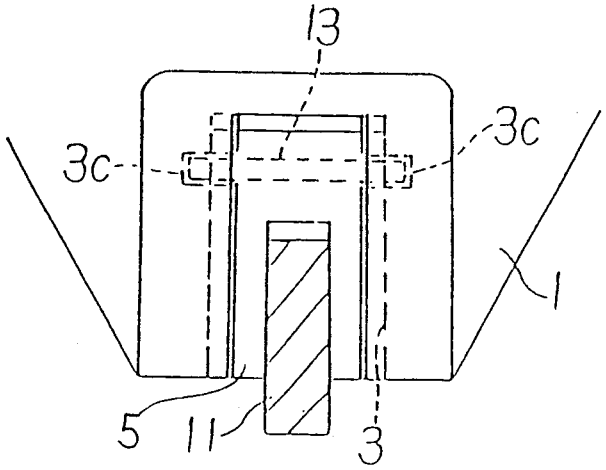
FIG. 10 PRIOR ART
FIG. 10 is a vertical sectional view of another conventional rotation preventing mechanism.
Figure 11:
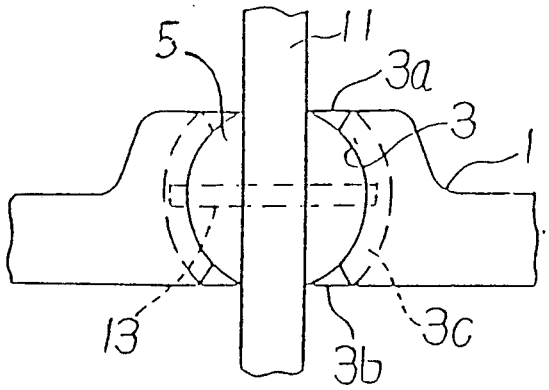
FIG. 11 PRIOR ART
FIG. 11 is a bottom view of the mechanism shown in FIG. 10.
Figure 12:
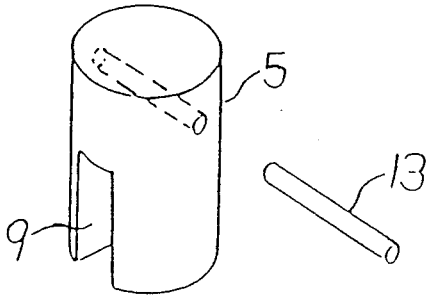
FIG. 12 PRIOR ART
FIG. 12 is a perspective view of the cylindrical block and pin shown in FIG. 10.

FIGS. 4 to 6 illustrate a retaining system according to a second embodiment of the present invention. In this embodiment, cylindrical block 59 has a vertical groove 61 on one side and female screw 79 on its other side. Stud bolt 81 (male screw), for example, a bolt having a hexagon socket or a slot on its head surface, is inserted into female screw 57 formed on wobble plate 49. These female screws 57 and 79 and male screw 81 constitute a retaining system.

Male screw 81 screwed into female screw 57 of wobble plate 49 projects from the bottom of hole 55 by the length corresponding to the length of female screw 79 (length A shown in FIG. 4). The male screw 81 is fixed by caulking with caulking jig 83 from the outside. Specifically, male screw 81 is locked in its circumferential direction relative to wobble plate 49. Female screw 79 is engaged with the projected portion of male screw 81 up to a predetermined length. Thus, cylindrical block 59 is retained in hole 55 of wobble plate 49.

The above embodiments have been explained with respect to variable-displacement compressors. However, the present invention can also be applied to a constant-displacement compressor.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

I claim:

1. In a wobble plate compressor comprising a compressor housing having a cylinder block provided with a plurality of cylinders and a crank chamber adjacent said cylinder block, a piston slidably fitted within each of said cylinders, a drive shaft rotatably supported in said housing, a rotor fixed on said drive shaft and connected to an inclined plate, a wobble plate adjacent said inclined plate with each of said plurality of pistons coupled at one end with said wobble plate, such that rotational motion of said inclined plate is converted into nutational motion of said wobble plate, and a rotation preventing mechanism to prevent rotation of said wobble plate, said rotation preventing mechanism having a guide plate extending within and fixed in said crank chamber, a cylindrical block including a vertical groove formed therein and retaining means for retaining said cylindrical block on said wobble plate such that said vertical groove is slidably fitted on said guide plate, the improvement comprising:

said retaining means including a female screw formed on one of said wobble plate and the upper surface of said cylindrical block and a male screw provided on the other of said wobble plate and the upper surface of said cylindrical block, said male screw being screwed in said female screw.

2. A wobble plate compressor according to claim 1 wherein said male screw is screwed in said female screw such that said cylindrical block is rotatably retained by said wobble plate.

3. A wobble plate compressor according to claim 1 wherein said cylindrical block is disposed in a hole formed in the periphery of said wobble plate.

4. A wobble plate compressor according to claim 1 wherein said crank chamber is formed between said cylinder block and a front end plate connected to said compressor housing, and said guide plate is supported by said cylinder block and said front end plate at its end portions.

5. A wobble plate compressor according to claim 1 wherein said male screw comprises a stud bolt.

6. A wobble plate compressor according to claim 5 wherein said stud bolt is fixed by caulking.

7. A wobble plate compressor according to claim 1 further comprising a variable displacement mechanism.

8. A wobble plate compressor according to claim 1 wherein said compressor is a constant displacement compressor.

9. A wobble plate compressor according to claim 1 wherein said male screw is formed on the periphery of said wobble plate.

10. A wobble plate compressor according to claim 1 wherein said female screw is formed on the periphery of said wobble plate.

* * * * *